US009524693B2

(12) United States Patent
Hong et al.

(10) Patent No.: US 9,524,693 B2
(45) Date of Patent: Dec. 20, 2016

(54) DISPLAY DEVICE AND METHOD FOR DRIVING THE SAME

(71) Applicant: LG DISPLAY CO., LTD., Seoul (KR)

(72) Inventors: Jincheol Hong, Paju-si (KR); Seungcheol Oh, Goyang-si (KR); Juhyun Oh, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 93 days.

(21) Appl. No.: 14/067,771

(22) Filed: Oct. 30, 2013

(65) Prior Publication Data

US 2014/0118235 A1 May 1, 2014

(30) Foreign Application Priority Data

Oct. 31, 2012 (KR) ..... 10-2012-0122485

(51) Int. Cl.
*G09G 3/36* (2006.01)
*G09G 5/00* (2006.01)

(52) U.S. Cl.
CPC ..... *G09G 5/008* (2013.01); *G09G 3/3648* (2013.01); *G09G 2310/0286* (2013.01); *G09G 2370/08* (2013.01); *G09G 2370/14* (2013.01)

(58) Field of Classification Search
CPC .. G09G 3/3688; G09G 3/3648; G09G 3/3696; G09G 2330/021; G09G 2310/08; G09G 2310/027; G09G 2310/0243; G09G 2370/08; G09G 2370/14; G09G 5/008; G09G 3/36; G09G 3/3685; G06F 11/00; G06F 11/076; H04L 1/20; H04L 1/24;H04L 1/241; H04L 7/0004; H04L 7/0016; H04L 12/56
See application file for complete search history.

(56) References Cited

U.S. PATENT DOCUMENTS

| | | | | |
|---|---|---|---|---|
| 7,898,518 | B2 | 3/2011 | Hong et al. | |
| 7,936,330 | B2 * | 5/2011 | Park | G09G 3/3611 345/100 |
| 7,948,465 | B2 | 5/2011 | Cho et al. | |
| 8,330,699 | B2 | 12/2012 | Hong et al. | |
| 8,775,879 | B2 * | 7/2014 | Oh | G09G 5/008 714/704 |
| 9,076,398 | B2 * | 7/2015 | Su | G09G 3/2092 |
| 9,087,474 | B2 * | 7/2015 | Seong | G09G 1/005 |
| 2010/0148829 | A1 * | 6/2010 | Hong et al. | 327/108 |
| 2011/0242066 | A1 * | 10/2011 | Jeon et al. | 345/204 |

(Continued)

*Primary Examiner* — Jonathan Boyd
*Assistant Examiner* — Sardis F Azongha
(74) *Attorney, Agent, or Firm* — Birch, Stewart, Kolasch & Birch, LLP

(57) ABSTRACT

A display device and a method for driving the same are discussed. The display device includes a display panel including data lines, gate lines crossing the data lines, and pixels, and source driver integrated circuits (ICs) which are connected to a timing controller through data line pairs, recover control information of a control data packet input from the timing controller, and supply a data voltage to the data lines. The timing controller sets the number of control data packets transmitted in a horizontal blank period to be less than the number of control data packets transmitted in a period except the horizontal blank period. The source driver ICs read the number of control data packets based on start information transmitted prior to the control data packet.

12 Claims, 7 Drawing Sheets

(56) References Cited

U.S. PATENT DOCUMENTS

| | | | | |
|---|---|---|---|---|
| 2011/0292024 | A1* | 12/2011 | Baek et al. | 345/212 |
| 2013/0201826 | A1* | 8/2013 | Testa | H04L 47/10 370/230 |

* cited by examiner

DISPLAY DEVICE AND METHOD FOR DRIVING THE SAME

This application claims the benefit of Korean Patent Application No. 10-2012-00122485 filed on Oct. 31, 2012, the entire contents of which is incorporated herein by reference for all purposes as if fully set forth herein.

BACKGROUND OF THE INVENTION

1. Field of the Invention

Embodiments of the invention relate to a display device and a method for driving the same.

2. Discussion of the Related Art

An active matrix liquid crystal display displays a motion picture using a thin film transistor (TFT) as a switching element. The active matrix liquid crystal display may be made to be smaller and more compact than a cathode ray tube (CRT) and thus may be applied to display units of portable information appliances, office equipments, computers, etc. Further, the active matrix liquid crystal display may be applied to televisions and thus is rapidly replacing the cathode ray tube.

A liquid crystal display includes a plurality of source driver integrated circuits (ICs) for supplying a data voltage to data lines of a liquid crystal display panel, a plurality of gate driver ICs for sequentially supplying a gate pulse (or a scan pulse) to gate lines of the liquid crystal display panel, a timing controller for controlling the source driver ICs and the gate driver ICs, etc.

The timing controller supplies digital video data, clocks for sampling of the digital video data, a control signal for controlling operations of the source driver ICs, etc. to the source driver ICs through an interface, for example, a mini low voltage differential signaling (LVDS) interface. The source driver ICs convert the digital video data received from the timing controller into an analog data voltage and supplies the analog data voltage to the data lines.

When the timing controller is connected to the source driver ICs in a multidrop manner through the mini LVDS interface, red (R) data transmission lines, green (G) data transmission lines, blue (B) data transmission lines, control lines for controlling operation timings of an output and a polarity conversion operation of the source driver ICs, clock transmission lines, etc are required between the timing controller and the source driver ICs. In the mini LVDS interface, RGB data, for example, RGB digital video data and a clock are transmitted as differential signal pair. Therefore, when odd data and even data are simultaneously transmitted, at least 14 lines are required between the timing controller and the source driver ICs for the transmission of the RGB data. When the RGB data is 10 bits, 18 lines are required. Thus, many lines has to be formed on a source printed circuit board (PCB) mounted between the timing controller and the source driver ICs. Hence, it is difficult to reduce a width of the source PCB.

A new signal transmission protocol (hereinafter referred to as "an EPI (clock Embedded Point-to-point Interface) protocol") for connecting the timing controller and the source driver ICs in a point-to-point manner to minimize the number of lines between the timing controller and the source driver ICs and to stabilize the signal transmission was disclosed in U.S. Pat. No. 8,330,699 (issued Dec. 11, 2012), U.S. Pat. No. 7,898,518 (issued Mar. 1, 2011), and U.S. Pat. No. 7,948,465 (issued May 24, 2011) corresponding to the present applicant, and which are hereby incorporated by reference in their entirety.

The EPI protocol satisfies the following interface regulations (1) to (3).

(1) A transmitting terminal of the timing controller is connected to receiving terminals of the source driver ICs via data line pairs in a point-to-point manner.

(2) Separate clock line pairs are not connected between the timing controller and the source driver ICs. The timing controller transmits video data and control data along with a clock signal to the source driver ICs through the data line pairs.

(3) A clock recovery circuit for clock and data recovery (CDR) is embedded in each of the source driver ICs. The timing controller transmits a clock training pattern signal or a preamble signal to the source driver ICs, so that an output phase and an output frequency of the clock recovery circuit should be locked. After the output phase of the clock recovery circuit embedded in each source driver IC is locked, the clock recovery circuit generates an internal clock when the clock training pattern signal and the clock signal are input through the data line pairs.

When a phase and a frequency of the internal clock are locked, the source driver ICs feedback-input a lock signal of a high logic level indicating an output stabilization state to the timing controller. The lock signal is feedback-input to the timing controller through a lock feedback signal line connected to the timing controller and the last source driver IC.

When the phase and the frequency of the internal clock are stably locked, the clock recovery circuit of each source driver IC and the timing controller form a data link. The timing controller starts to transmit the video data and the control data to the source driver ICs in response to the lock signal received from the last source driver IC.

When the output phase and the output frequency of the clock recovery circuit embedded in even one of the source driver ICs are unlocked, the lock signal is inverted to a low logic level. The last source driver IC transmits the lock signal of the low logic level to the timing controller. In this instance, the timing controller retransmits the clock training pattern signal to all the source driver ICs and resumes clock training of the source driver ICs.

The EPI protocol is configured as a plurality of control data packets each having a predetermined length including a plurality of control informations for controlling the source driver ICs. An amount of control information included in one control data packet is limited. Thus, when one control data packet includes the control information exceeding its limited amount, the number of control data packets transmitted to the source driver ICs increases.

The control data packet is transmitted during a horizontal blank period. The horizontal blank period is a very short time, in which there is no data, between an Nth horizontal period, in which Nth line data is written to pixels of an Nth line of the display panel, and an (N+1)th horizontal period, in which (N+1)th line data is written to pixels of an (N+1)th line of the display panel, where N is a positive integer. When a sum of the lengths of the plurality of control data packets increases, a horizontal blank margin is lack. Hence, an image displayed on the display panel may be distorted, or erroneous operations of the source driver ICs may be caused.

SUMMARY OF THE INVENTION

Embodiments of the invention provide a display device and a method for driving the same capable of securing a horizontal blank margin even if an amount of control information to be transmitted to source driver integrated circuits increases.

A display device according to the embodiments of the invention includes a display panel including data lines, gate lines crossing the data lines, and pixels arranged in a matrix form, and source driver integrated circuits (ICs) which are connected to a timing controller through data line pairs, recover control information of a control data packet input from the timing controller, and supply a data voltage of video data to the data lines.

The timing controller sets the number of control data packets transmitted in a horizontal blank period to be less than the number of control data packets transmitted in a period except the horizontal blank period.

The source driver ICs read the number of control data packets based on start information transmitted prior to the control data packet.

A method for driving the display device according to the embodiments of the invention includes setting the number of control data packets transmitted in a horizontal blank period to be less than the number of control data packets transmitted in a period except the horizontal blank period, and defining the number of control data packets based on start information transmitted to the source driver ICs prior to the control data packet.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

A display device according to an exemplary embodiment of the invention may be implemented as a flat panel display, such as a liquid crystal display (LCD), a field emission display (FED), a plasma display panel (PDP), and an organic light emitting display. In the following description, the embodiment of the invention will be described using the liquid crystal display as an example of the flat panel display. Other flat panel displays may be used.

Figure 1:
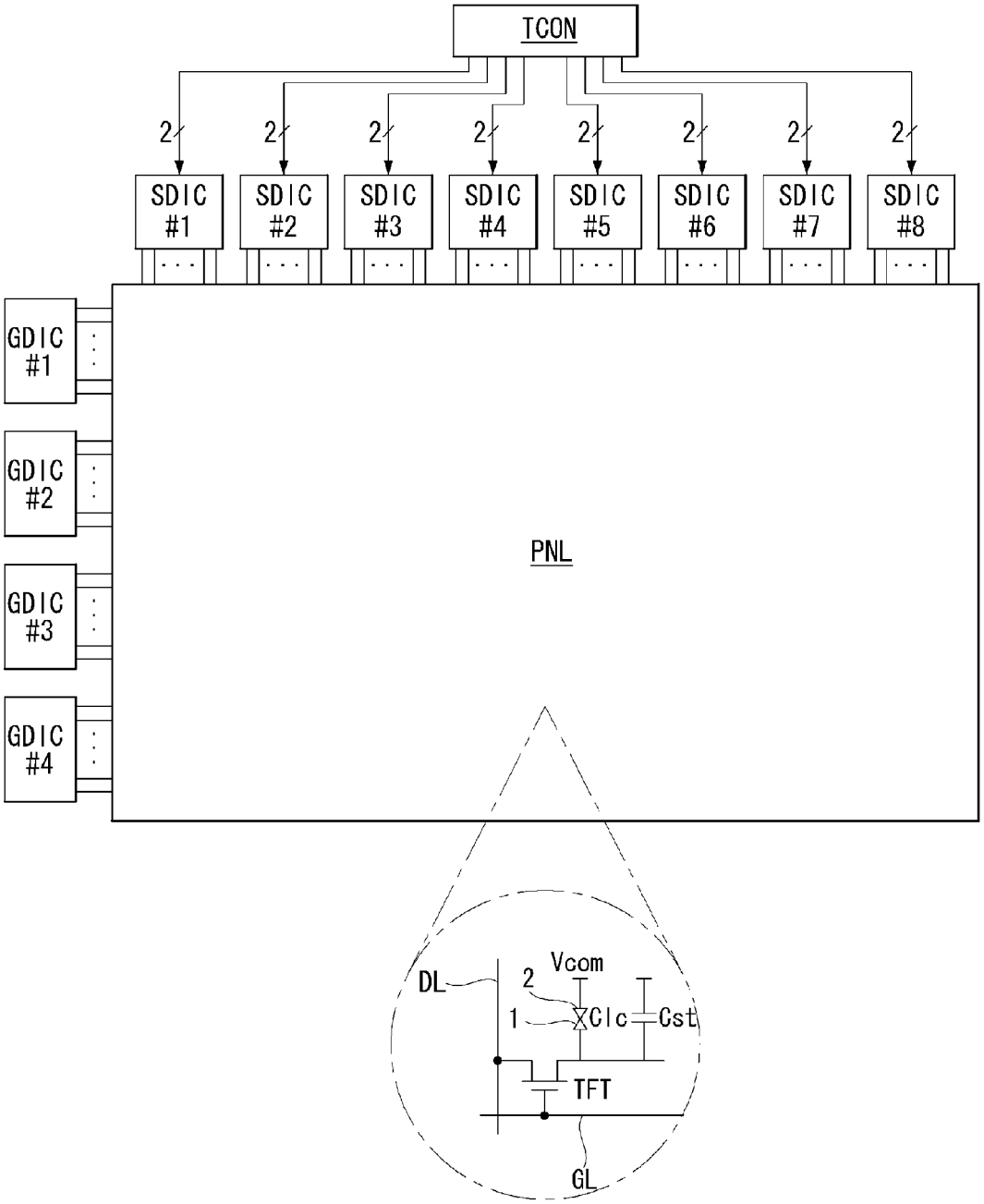
FIG. 1 is a block diagram of a liquid crystal display according to an exemplary embodiment of the invention.

As shown in FIG. 1, the display device according to the embodiment of the invention includes a display panel PNL, a timing controller TCON, source driver integrated circuits (ICs) SDIC#1 to SDIC#8, and gate driver ICs GDIC#1 to GDIC#4.

A liquid crystal layer is formed between substrates of the display panel PNL. The display panel PNL includes m×n liquid crystal cells Clc arranged in a matrix form based on a crossing structure of m data lines DL and n gate lines GL, where m and n are a positive integer.

A pixel array including the data lines DL, the gate lines GL, thin film transistors (TFTs), storage capacitors Cst, etc. is formed on a lower glass substrate of the display panel PNL. Each of the liquid crystal cells Clc is driven by an electric field between a pixel electrode 1, to which a data voltage is supplied through the TFT, and a common electrode 2, to which a common voltage Vcom is supplied. A gate electrode of the TFT is connected to the gate line GL, and a source electrode of the TFT is connected to the data line DL. A drain electrode of the TFT is connected to the pixel electrode 1 of the liquid crystal cell Clc. The TFT is turned on in response to a gate pulse supplied through the gate line GL and supplies positive and negative analog data voltages from the data line DL to the pixel electrode 1 of the liquid crystal cell Clc.

Black matrixes, color filters, etc. are formed on an upper glass substrate of the display panel PNL. In a vertical electric field driving manner such as a twisted nematic (TN) mode and a vertical alignment (VA) mode, the common electrodes 2 are formed on the upper glass substrate. In a horizontal electric field driving manner such as an in-plane switching (IPS) mode and a fringe field switching (FFS) mode, the common electrodes 2 are formed on the lower glass substrate along with the pixel electrodes 1.

Polarizing plates are respectively attached to the upper glass substrate and the lower glass substrate of the display panel PNL. Alignment layers for setting a pre-tilt angle of liquid crystals are respectively formed on the upper and lower glass substrates of the display panel PNL. A spacer is formed between the upper and lower glass substrates of the display panel PNL to keep cell gaps of the liquid crystal cells Clc constant.

A liquid crystal mode of a liquid crystal display panel applicable to the embodiment of the invention may be implemented in any liquid crystal mode as well as the TN mode, the VA mode, the IPS mode, and the FFS mode. Further, the liquid crystal display according to the embodiment of the invention may be implemented as any type liquid crystal display including a transmissive liquid crystal display, a transflective liquid crystal display, and a reflective liquid crystal display.

The timing controller TCON receives external timing signals, such as a vertical sync signal Vsync, a horizontal sync signal Hsync, an external data enable signal DE, and a main clock CLK, from an external host system. The timing controller TCON generates timing control signals for controlling the source driver ICs SDIC#1 to SDIC#8 and the gate driver ICs GDIC#1 to GDIC#4 using the external timing signals. The timing control signals include a gate timing control signal for controlling operation timing of the gate driver ICs GDIC#1 to GDIC#4 and a source timing control signal for controlling operation timing of the source driver ICs SDIC#1 to SDIC#8.

The gate timing control signal includes a gate start pulse GSP, a gate shift clock GSC, a gate output enable signal GOE, etc. The gate start pulse GSP indicates a start timing of a scan operation, so that a first gate pulse is generated by the first gate driver IC GDIC#1. The gate shift clock GSC is a clock for shifting the gate start pulse GSP. A shift register of each of the gate driver ICs GDIC#1 to GDIC#4 shifts the gate start pulse GSP at a rising edge of the gate shift clock GSC. Each of the gate driver ICs GDIC#1 to GDIC#4 receives a carry signal of the previous gate driver IC as the gate start pulse and starts to operate. The gate output enable signal GOE controls an output timing of the gate driver ICs GDIC#1 to GDIC#4. The gate timing control signal may be encoded to a control data packet and may be transmitted to the source driver ICs SDIC#1 to SDIC#8. The source driver ICs SDIC#1 to SDIC#8 may recover the gate timing control signal from the control data packet and may transmit the recovered gate timing control signal to the gate driver ICs GDIC#1 to GDIC#4. When the gate timing control signal generated by the timing controller TCON is directly transmitted to the gate driver ICs GDIC#1 to GDIC#4, gate timing control information may be omitted in the control data packet.

The gate driver ICs GDIC#1 to GDIC#4 sequentially supply the gate pulse synchronized with the data voltage to the gate lines GL in response to the gate timing control signal.

The source timing control signal includes control information for controlling operations of the source driver ICs SDIC#1 to SDIC#8. For example, the source timing control signal includes polarity control information, source output timing information, etc. The source driver ICs SDIC#1 to SDIC#8 recover the polarity control information and generate an internal polarity control signal POL, thereby inverting a polarity of the data voltage depending on a logic level of a polarity control signal. The source driver ICs SDIC#1 to SDIC#8 recover the source output timing information and generates an internal source output enable signal SOE. The output timing of the data voltage output from the source driver ICs SDIC#1 to SDIC#8 is controlled based on a logic level of the internal source output enable signal SOE. The source output enable signal SOE may be encoded to the control data packet and may be transmitted to the source driver ICs SDIC#1 to SDIC#8.

A circuit generating positive and negative gamma compensation voltages may be embedded in each of the source driver ICs SDIC#1 to SDIC#8. In this instance, the source timing control signal transmitted to the source driver ICs SDIC#1 to SDIC#8 through the control data packet may include gamma compensation control information for controlling the gamma compensation voltages.

The source driver ICs SDIC#1 to SDIC#8 may recover the gate timing control signal from the control data packet and may transmit the recovered gate timing control signal to the gate driver ICs GDIC#1 to GDIC#4.

The source driver ICs SDIC#1 to SDIC#8 include a clock training pattern signal or a preamble signal, the control data packet, and a video data packet which are received from the timing controller TCON through data line pairs. The control data packet may include the control informations of the source timing control signal and the control informations of the gate timing control signal.

The source driver ICs SDIC#1 to SDIC#8 receive the clock training pattern signal and lock an output phase and an output frequency of a clock recovery circuit embedded in each of the source driver ICs SDIC#1 to SDIC#8. After the output phase and the output frequency of the clock recovery circuit of each source driver IC are locked, the source driver ICs SDIC#1 to SDIC#8 recover clock bit input in a bit stream through the data line pairs and recover an internal clock signal. Subsequently, the source driver ICs SDIC#1 to SDIC#8 sample a bit stream of the control data packet in conformity with a clock timing of the internal clock signal and recover control information received through the control data packet. Subsequently, the source driver ICs SDIC#1 to SDIC#8 sample RGB bits of the video data packet received through the data line pairs in conformity with the clock timing of the internal clock signal and recover RGB digital video data. The source driver ICs SDIC#1 to SDIC#8 convert the recovered RGB digital video data into the gamma compensation voltages and generate the data voltage. The source driver ICs SDIC#1 to SDIC#8 invert the polarity of the data voltage in response to the internal polarity control signal POL recovered from the control data packet and output the data voltage in response to the internal source output enable signal SOL recovered from the control data packet.

Figure 2:
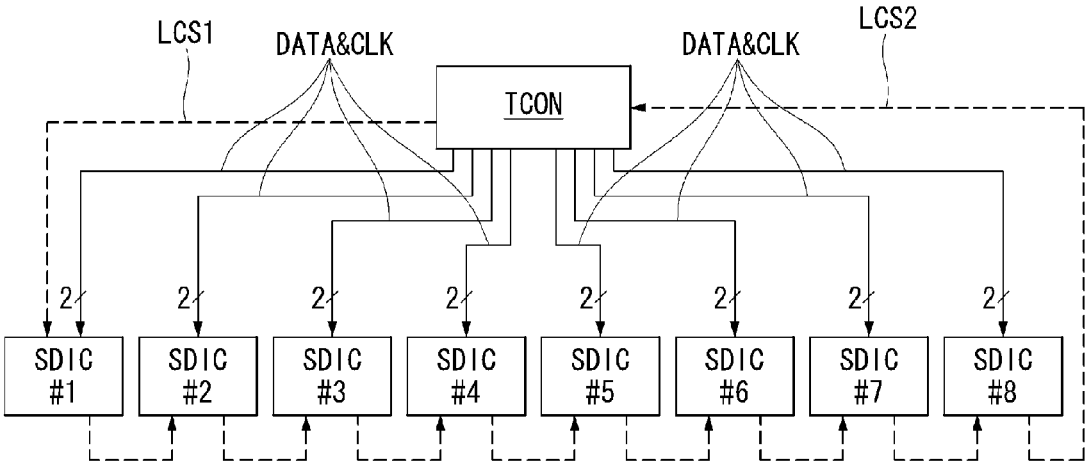
FIG. 2 illustrates lines between a timing controller and source driver integrated circuits (ICs) shown in FIG. 1.

FIG. 2 illustrates lines between the timing controller TCON and the source driver ICs SDIC#1 to SDIC#8.

As shown in FIG. 2, data line pairs DATA&CLK, lock check lines LCS1, etc. are formed between the timing controller TCON and the source driver ICs SDIC#1 to SDIC#8.

The data line pairs DATA&CLK connect the timing controller TCON in series to the source driver ICs SDIC#1 to SDIC#8 in one-to-one manner, i.e., a point-to-point manner. The timing controller TCON sequentially transmits the clock training pattern signal, the control data packet, and the video data packet to the source driver ICs SDIC#1 to SDIC#8 through the data line pairs DATA&CLK. The control data packet may be configured as clock bit, control start bit, and bit stream including the source timing control information and the gate timing control information. The source timing control information and the gate timing control information include the control information of the above-described source timing control signal and the control information of the above-described gate timing control signal. The video data packet is a bit stream including clock bit, internal data enable bit, RGB data bit, etc. Each of the source driver ICs SDIC#1 to SDIC#8 recovers the internal clock signal input through the data line pairs DATA&CLK. A line for transmitting a clock carry and the RGB data is not required between the adjacent source driver ICs SDIC#1 to SDIC#8.

The timing controller TCON transmits the clock training pattern signal to the source driver ICs SDIC#1 to SDIC#8 and stably locks the phase and the frequency of the internal clock signal output from the clock recovery circuit of each of the source driver ICs SDIC#1 to SDIC#8. The timing controller TCON may transmit a lock signal LOCK, for confirming that the outputs of the clock recovery circuits of the source driver ICs SDIC#1 to SDIC#8 are stably locked, to the first source driver IC SDIC#1 through the lock check lines LCS1. The source driver ICs SDIC#1 to SDIC#8 may be cascade-connected to one another through lines (indicated by dotted lines of FIG. 2) used to transmit the lock signal LOCK between the source driver ICs SDIC#1 to SDIC#8. The first source driver IC SDIC#1 receives the clock training pattern signal and transmits the lock signal LOCK of a high logic level to the second source driver IC SDIC#2 when the output phase and the output frequency of its clock recovery circuit are locked. The second source driver IC SDIC#2 receives the clock training pattern signal and transmits the lock signal LOCK of the high logic level to the third source driver IC SDIC#3 when the output phase and the output frequency of its clock recovery circuit are locked. After the output phases and the output frequencies of the clock recovery circuits of all the source driver ICs SDIC#1 to SDIC#8 are locked (i.e., when the output phase and the output frequency of the clock recovery circuit of the last source driver IC SDIC#8 are locked), the last source driver IC SDIC#8 transmits the lock signal LOCK of the high logic level to the timing controller TCON through a feedback lock check line LCS2. When the timing controller TCON receives the feedback input of the lock signal LOCK from the last source driver IC SDIC#8, the timing controller TCON starts to transmit the bit stream of the control data packet and the video data packet to the source driver ICs SDIC#1 to SDIC#8. Thus, the timing controller TCON transmits the clock training pattern signal to the source driver ICs SDIC#1 to SDIC#8 through the data line pairs DATA&CLK until the output phases and the output frequencies of the clock recovery circuits of all the source driver ICs SDIC#1 to SDIC#8 are stably locked. After the timing controller TCON confirms that the output phases and the output frequencies of the clock recovery circuits of all the source driver ICs SDIC#1 to SDIC#8 are locked, the timing controller TCON starts to transmit the control data packet and the video data packet to the source driver ICs SDIC#1 to SDIC#8.

The source driver ICs SDIC#1 to SDIC#8 recover the internal source output enable signal SOE from the control data packet received under EPI (clock Embedded Point-to-point Interface) protocol and may adjust output timing depending on the logic level of the internal source output enable signal SOE. For example, the source driver ICs SDIC#1 to SDIC#8 output the data voltage during a period ranging from a falling edge of the internal source output enable signal SOE to a rising edge of the internal source output enable signal SOE subsequent to the falling edge. In this instance, when the data voltage starts to be output at the falling edge of the internal source output enable signal SOE, a peak current is generated. The peak current affects the clock recovery circuits of the source driver ICs SDIC#1 to SDIC#8 and thus may lead to a distortion of the internal clock recovered by the clock recovery circuits.

Figure 3:
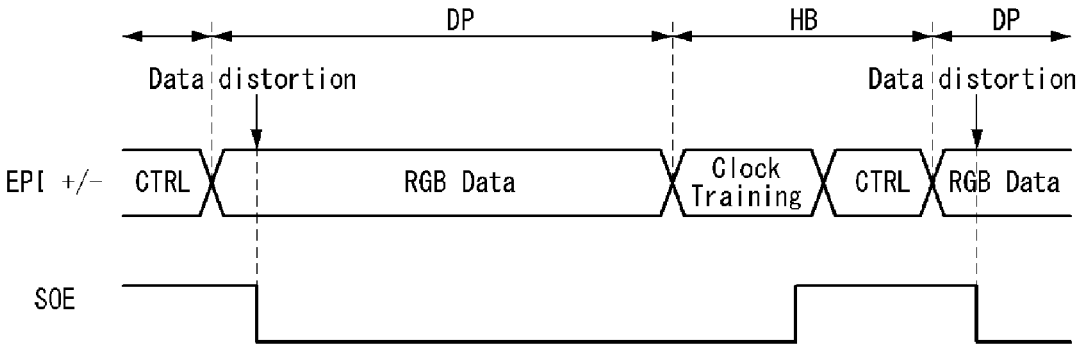
FIG. 3 illustrates an example of an overlap between a falling edge of an internal source output enable signal and a video data packet.
Figure 4:
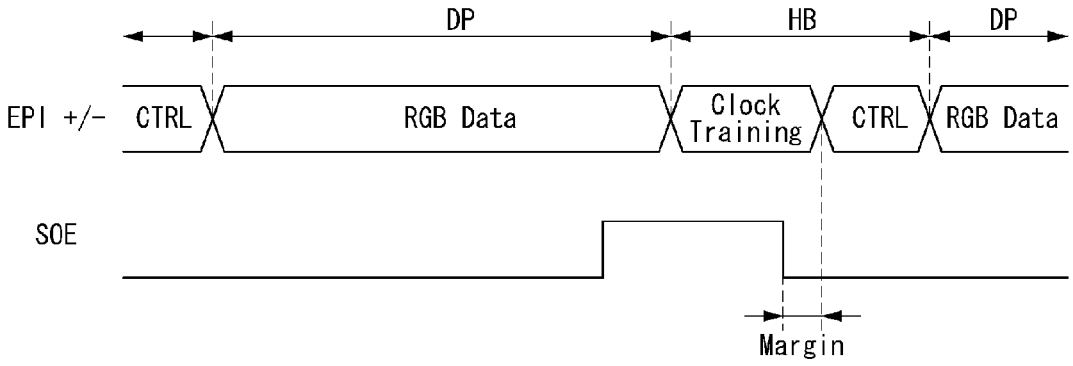
FIG. 4 illustrates an example of securing a horizontal blank margin by advancing a falling edge of an internal source output enable signal.
Figure 5:
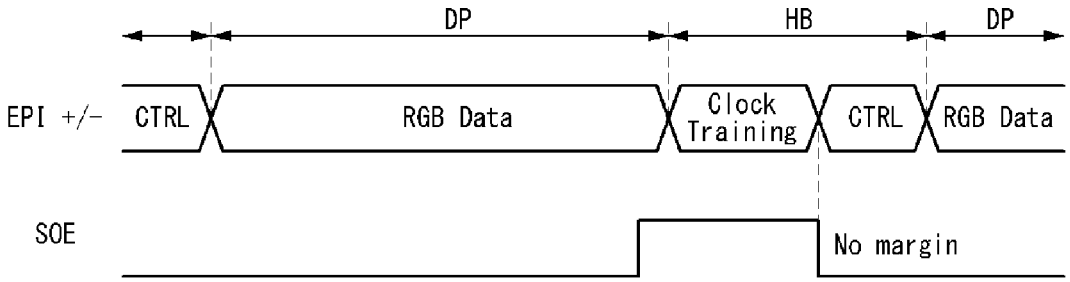
FIG. 5 illustrates an example when a horizontal blank margin is not secured when the number of successively transmitted control data packets increases even if a falling edge of an internal source output enable signal is advanced.

As shown in FIG. 3, when the falling edge timing of the internal source output enable signal SOE recovered inside the source driver ICs SDIC#1 to SDIC#8 overlaps video data packet 'RGB Data' which is being received, a distortion of data displayed on the display panel PNL may be generated. This is because the clock recovery circuits erroneously operate due to the peak current and the problem is generated in the sampling of the video data. When the falling edge timing of the internal source output enable signal SOE overlaps the control data packet CTRL, the control informations are not normally recovered. Therefore, the source driver ICs SDIC#1 to SDIC#8 or the gate driver ICs GDIC#1 to GDIC#4 may erroneously operate. In FIGS. 3 to 5, "EPI +/−" denotes EPI protocol data received to the source driver ICs SDIC#1 to SDIC#8

As shown in FIG. 4, when the falling edge timing of the internal source output enable signal SOE overlaps the clock training pattern signal through changes in the timing of the internal source output enable signal SOE, the distortion of the video data displayed on the display panel PNL and the distortion of the control informations may be reduced. In FIG. 4, a horizontal blank margin is a period of time ranging from the falling edge of the internal source output enable signal SOE to an end of the clock training pattern signal. When the falling edge of the internal source output enable signal SOE is positioned inside the horizontal blank margin, the source driver ICs SDIC#1 to SDIC#8 or the gate driver ICs GDIC#1 to GDIC#4 do not erroneously operate, and the distortion of the data displayed on the display panel PNL may be prevented. However, when much control informations are added to the control data packet even if the falling edge of the internal source output enable signal SOE is advanced as shown in FIG. 4, the number of successively transmitted control data packets increases. Therefore, as shown in FIG. 5, the horizontal blank margin cannot be secured.

Figure 6:
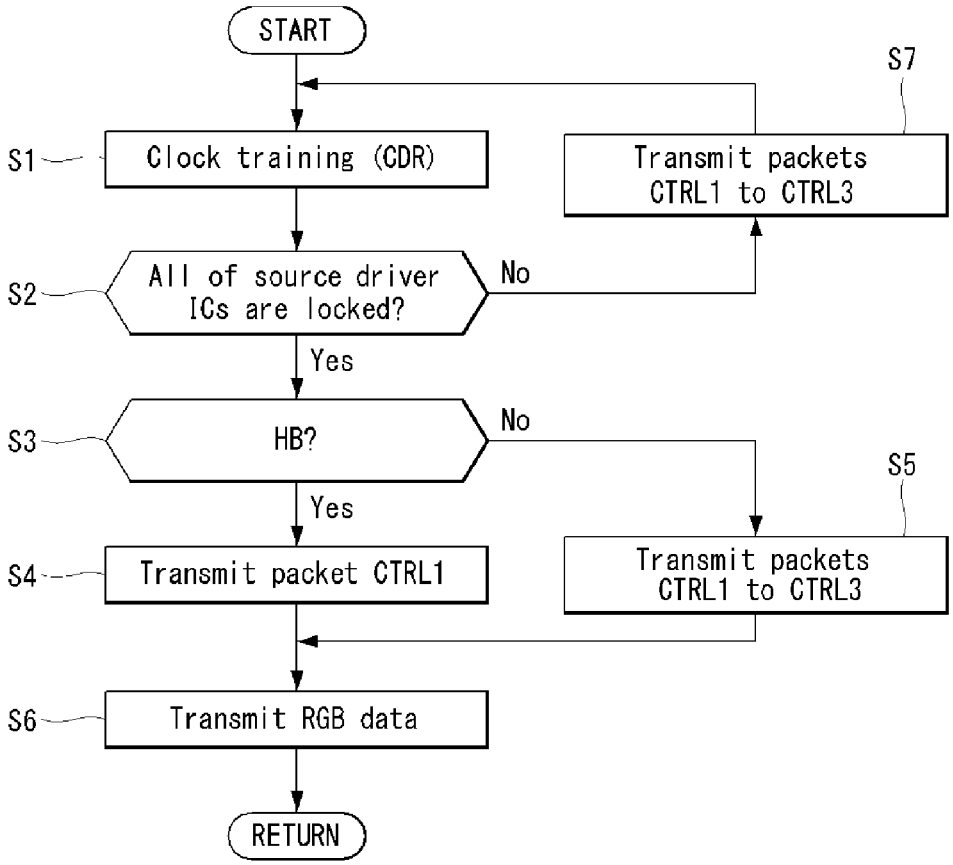
FIG. 6 is a flow chart sequentially illustrating a method for driving a display device according to an exemplary embodiment of the invention.

FIG. 6 is a flow chart sequentially illustrating a method for driving the display device according to the embodiment of the invention.

As shown in FIG. 6, the timing controller TCON transmits the clock training pattern signal to the source driver ICs SDIC#1 to SDIC#8 through the data line pairs DATA&CLK in step S1. The source driver ICs SDIC#1 to SDIC#8 receive the clock training pattern signal and lock a phase and a frequency of the internal clock signal output from the clock recovery circuit embedded in each of the source driver ICs SDIC#1 to SDIC#8 in step S2. In steps S3 to S7, after the timing controller TCON confirms that the internal clock recovery of all the source driver ICs SDIC#1 to SDIC#8 are stabilized, the timing controller TCON sequentially transmits the control data packet and the video data packet to the source driver ICs SDIC#1 to SDIC#8 through the data line pairs DATA&CLK in the order named.

The control data packet is transmitted in a power-on period, a vertical blank period, a lock fail period, and a horizontal blank period HB. The total number of control data packets or a length of the control data packet may be differently set depending on a transmission period. The power-on period is a period in which the display device is powered on. The driving circuits including the timing controller TCON, the source driver ICs SDIC#1 to SDIC#8, the gate driver ICs GDIC#1 to GDIC#4, etc. are initialized during the power-on period. The vertical blank period is a period of time, in which no data is input, between an Nth frame period and an (N+1)th frame period, where N is a positive integer. The lock fail period is a period in which when the phase and the frequency of the internal clock generated inside the source driver ICs SDIC#1 to SDIC#8 are not locked, the clock training pattern signal is transmitted. The horizontal blank period HB is a very short period of time, in which there is no data, between an Nth horizontal period and an (N+1)th horizontal period, where N is a positive integer.

Lengths of the power-on period, the vertical blank period, and the lock fail period are relatively longer than a length of the horizontal blank period HB. Thus, the number of control data packets transmitted in the power-on period, the vertical blank period, and the lock fail period increases. On the other hand, the number or the length of control data packets transmitted in the horizontal blank period HB decreases, so that the horizontal blank margin can be secured.

Because the number or the length of control data packets transmitted in the horizontal blank period HB decreases, the control data packet of the horizontal blank period HB includes only control informations which are necessarily used in the operation control of the source driver ICs SDIC#1 to SDIC#8 and have a logic value of a short change cycle. More specifically, the control data packet transmitted in the horizontal blank period HB may include only necessary control informations, for example, source output enable signal related information and polarity control signal related information, which are necessarily used in the operation control of the source driver ICs SDIC#1 to SDIC#8 and have to be transmitted in each horizontal period because a logic value of the control information is inverted in each horizontal period.

Because the control data packet transmitted in the power-on period, the vertical blank period, and the lock fail period relatively has an allowance in its number or length, the control data packet may include selection option control informations as well as the necessary control informations. The control data packet may include only the selection option control informations or may include the necessary control informations and the selection option control informations. The selection option control informations are not necessarily used in the operation control of the source driver ICs SDIC#1 to SDIC#8 and do not need to be transmitted in each horizontal period. For example, the selection option control informations may include gamma compensation control informations for setting the gamma compensation voltage produced inside the source driver ICs SDIC#1 to SDIC#8.

The necessary control informations and the selection option control informations encoded to the control data packets may be added or changed in consideration of driving characteristics of the display device and driving characteristics of the source driver ICs. For example, the polarity control signal belongs to the necessary control information in the liquid crystal display, but is not necessary in the organic light emitting display.

FIG. 6 shows that first to third control data packets CTRL1 to CTRL3 are transmitted in the power-on period, the vertical blank period, and the lock fail period in steps S7 to S7, and the first control data packet CTRL1 is transmitted in the horizontal blank period HB. The embodiment of the invention is not limited to the driving method illustrated in FIG. 6 which is just an example of the driving method. For example, the embodiment of the invention may transmit the control data packet having a long packet length in the power-on period, the vertical blank period, and the lock fail period and may transmit the control data packet having a short packet length in the horizontal blank period HB. Further, the embodiment of the invention may transmit the 'i' control data packets (for example, the control data packets CTRL1 to CTRL3 in FIG. 6) in the power-on period, the vertical blank period, and the lock fail period and may transmit the 'i' control data packets (for example, the control data packet CTRL1 in FIG. 6) in the horizontal blank period HB, where 'i' is a positive integer equal to or greater than 3 and 'j' is a positive integer equal to or greater than 1 and less than 'i'.

Figure 8:
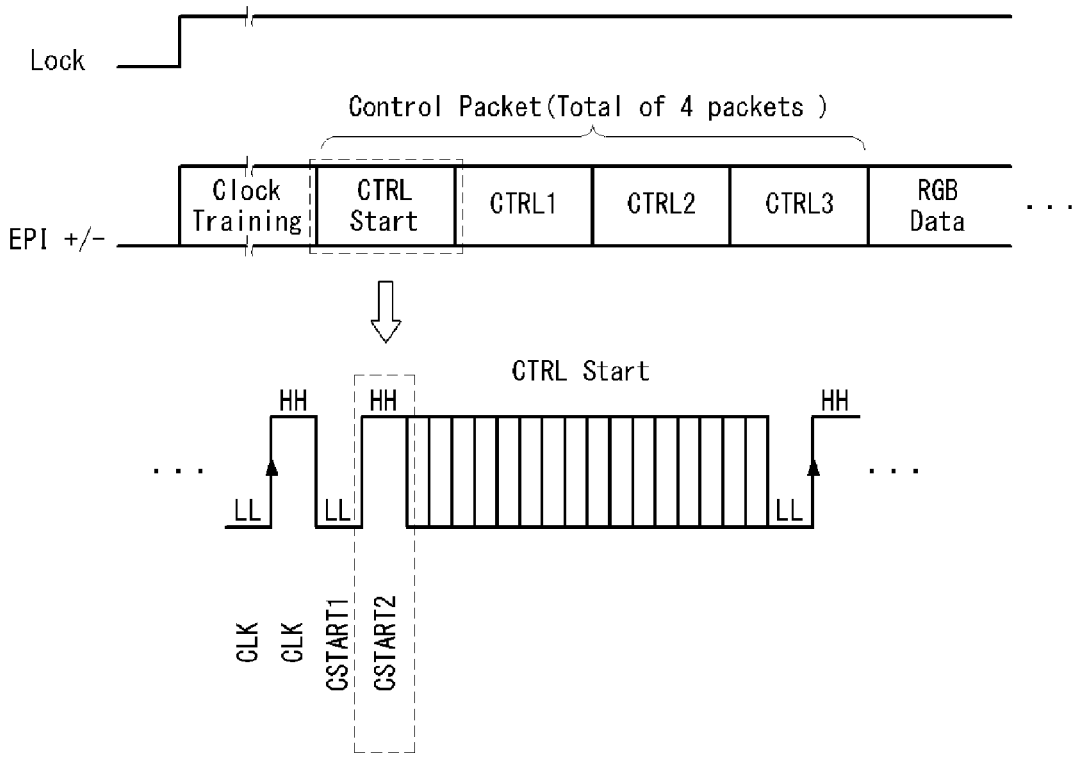
FIG. 8 illustrates an example of start information transmitted in a period except a horizontal blank period.
Figure 9:
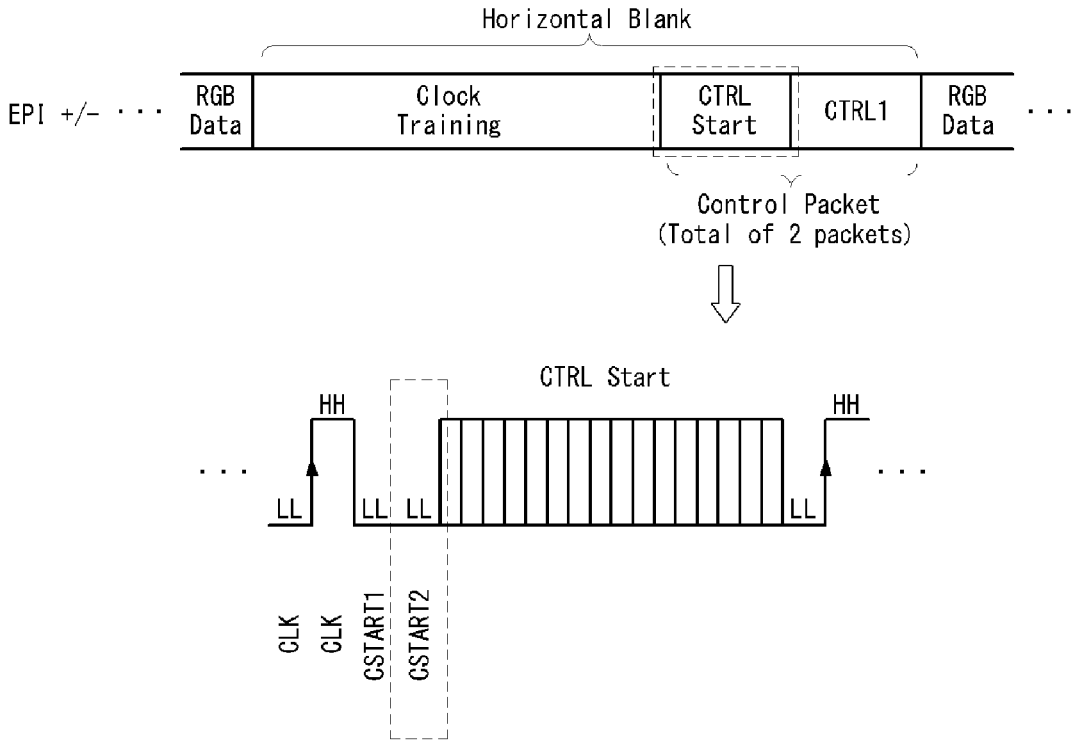
FIG. 9 illustrates an example of start information transmitted in a horizontal blank period.

In the EPI protocol, start informations indicating data attributes are assigned in the front of each of the control data packet and the video data packet, so that the source driver ICs SDIC#1 to SDIC#8 may recognize that upcoming data to be received is any type of data. The source driver ICs SDIC#1 to SDIC#8 read the start informations defined in the EPI protocol and thus may recognize that data to be received subsequent to the start informations is any type of data. For example, as shown in FIGS. 8 and 9, start informations including a first control start bit CSTART1, a second control start bit CSTART2, and a control start packet CTRL Start are transmitted to the source driver ICs SDIC#1 to SDIC#8 before the control data packets CTRL1 to CTRL3 are transmitted to the source driver ICs SDIC#1 to SDIC#8. The embodiment of the invention may set some bits of the start informations, which are transmitted earlier than the control data packets under the EPI protocol, to bits defining the number or the length of control data packets. For example, as shown in FIGS. 8 and 9, the second control start bit CSTART2 may be set to bits defining the number or the length of control data packets.

The second control start bit CSTART2 may be configured as 2 bits. In the following description, when a logic value of the second control start bit CSTART2 is HH (High High) or $11_2$, the number of control data packets following the second control start bit CSTART2 is three. Further, when the logic value of the second control start bit CSTART2 is LL (Low Low) or $00_2$, the number of control data packets following the second control start bit CSTART2 is one. The embodiment of the invention is not limited thereto.

Figure 7:
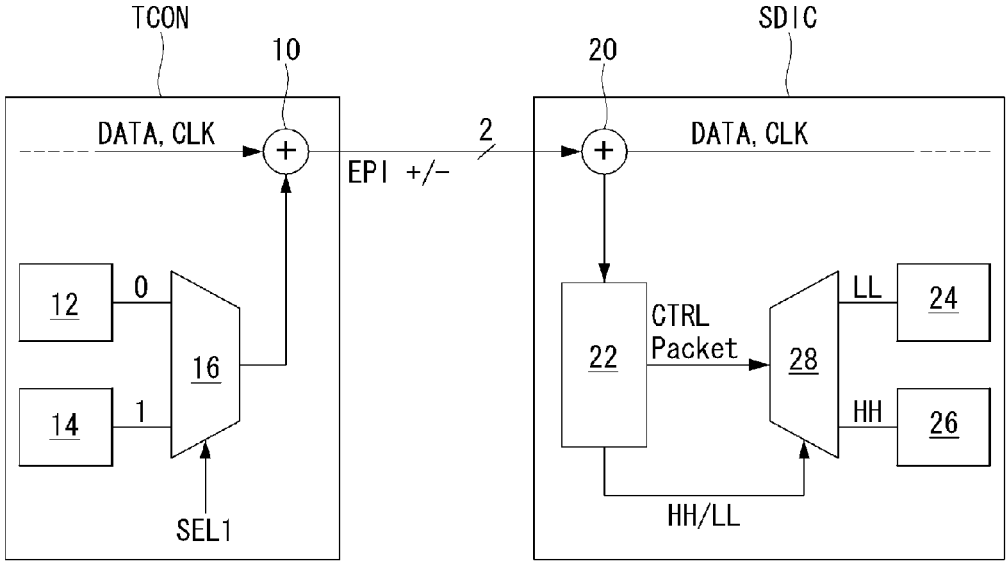
FIG. 7 illustrates a transmitting and receiving circuit related to control data packets in a timing controller and source driver ICs shown in FIG. 2.

FIG. 7 illustrates a transmitting and receiving circuit related to the control data packets in the timing controller TCON and the source driver ICs SDIC#1 to SDIC#8 shown in FIG. 2. FIG. 8 illustrates an example of start informations transmitted in a period except a horizontal blank period. FIG. 9 illustrates an example of start information transmitted in a horizontal blank period.

As shown in FIGS. 7 and 8, the timing controller TCON includes a first register 12, a second register 14, a multiplexer 16, a transmitting unit 10, etc.

The first register 12 stores start information transmitted in the horizontal blank period HB and a bit stream of the first control data packet CTRL1. The second register 14 stores start information transmitted in a period (i.e., the power-on period, the vertical blank period, and the lock fail period) except the horizontal blank period HB and bit streams of the first to third control data packets CTRL1 to CTRL3.

The timing controller TCON counts the external timing signals such as the vertical sync signal Vsync, the horizontal sync signal Hsync, the external data enable signal DE, and the main clock CLK, or confirms a logic value of a feedback lock signal, thereby deciding the power-on period, the vertical blank period, the horizontal blank period HB, and the lock fail period. The timing controller TCON may output a MUX selection signal SEL as a signal having a logic value '1' in the power-on period, the vertical blank period, and the lock fail period. On the other hand, the timing controller TCON may output the MUX selection signal SEL as a signal having a logic value '0' in the horizontal blank period HB.

The multiplexer 16 selects an output of the first register 12 and an output of the second register 14. For example, when the logic value of the MUX selection signal SEL is '0', the multiplexer 16 supplies the bit stream from the first register 12 to the transmitting unit 10. On the other hand, when the logic value of the MUX selection signal SEL is 1', the multiplexer 16 supplies the bit stream from the second register 14 to the transmitting unit 10. The transmitting unit 10 transmits the bit stream from the multiplexer 16 to the source driver ICs SDIC#1 to SDIC#8 through the data line pairs DATA&CLK.

The timing controller TCON transmits the start information and the bit stream of the first control data packet CTRL1 which are stored in the first register 12 in the horizontal blank period HB, to the source driver ICs SDIC#1 to SDIC#8 through the data line pairs DATA&CLK. If the control data packet transmitted in the horizontal blank period HB includes the control start packet CTRL Start including only the start information without the control information, the control data packet transmitted in the horizontal blank period HB may be transmitted as a total of two packets adding the control start packet CTRL Start and the first control data packet CTRL1. In the start information stored in the first register 12, a logic value of the second control start bit CSTART2 is "LL (Low Low)" defining that the control data packet transmitted subsequent to the start information is configured as the first control data packet CTRL1.

On the other hand, the timing controller TCON transmits the start information and the bit streams of the first to third control data packets CTRL1 to CTRL3 which are stored in the second register 14 in the period (i.e., the power-on period, the vertical blank period, and the lock fail period) except the horizontal blank period HB, to the source driver ICs SDIC#1 to SDIC#8 through the data line pairs DATA&CLK. The control data packet transmitted in the period except the horizontal blank period HB may be transmitted as a total of four packets adding the control start packet CTRL Start and the first to third control data packets CTRL1 to CTRL3. In the start information stored in the second register 14, a logic value of the second control start bit CSTART2 is "HH (High High)" defining that the control data packet transmitted subsequent to the start information is configured as the first to third control data packets CTRL1 to CTRL3.

The source driver ICs SDIC#1 to SDIC#8 include a receiving unit 20, a start information extraction unit 22, a demultiplexer 28, a first register 24, a second register 26, etc.

The start information extraction unit 22 reads start information of data received through the receiving unit 20 and extracts the second control start bit CSTART2 from the start information when the start information is start information followed by a previously determined control data packet. The start information extraction unit 22 controls the demultiplexer 28 based on the logic value of the second control start bit CSTART2.

When the logic value of the second control start bit CSTART2 is "HH" as shown in FIG. 8, the demultiplexer 28 stores the control data packet received input from the start information extraction unit 22 in the second register 26. When the logic value of the second control start bit CSTART2 is "LL" as shown in FIG. 9, the demultiplexer 28 stores the control data packet input from the start information extraction unit 22 in the first register 24. Thus, the source driver ICs SDIC#1 to SDIC#8 store the first control data packet CTRL1 received in the horizontal blank period HB in the first register 24. On the other hand, the source driver ICs SDIC#1 to SDIC#8 store the bit streams of the first to third control data packets CTRL1 to CTRL3 received in the period (i.e., the power-on period, the vertical blank period, and the lock fail period) except the horizontal blank period HB in the second register 26. The source driver ICs SDIC#1 to SDIC#8 recover the control informations of the control data packets read by the first and second registers 24 and 26.

As described above, the embodiment of the invention causes the number of control data packets transmitted in the horizontal blank period to be less than the number of control data packets transmitted in the period except the horizontal blank period, thereby varying the lengths of the control data packets. As a result, the embodiment of the invention may secure the horizontal blank margin even if an amount of informations transmitted to the source driver ICs of the display device driven under the EPI protocol increases.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel including data lines, gate lines crossing the data lines, and pixels arranged in a matrix form; and source driver integrated circuits (ICs) which are connected to a timing controller through data line pairs and are configured to recover control information of a control data packet input from the timing controller and supply a data voltage of video data to the data lines, wherein:

the timing controller sets a number of control data packets transmitted in a horizontal blank period to be less than a number of control data packets transmitted in a period except the horizontal blank period, the source driver ICs read the number of control data packets based on start information transmitted prior to the control data packets by extracting a second control start bit from the start information via a start information extracting unit, the start information includes a first control start bit, the second control start bit, and a control start packet, and the timing controller sets the number of control data packets based on the second control start bit that is subsequent to the first control start bit.

2. The display device of claim 1, wherein the period except the horizontal blank period includes a power-on period, a vertical blank period, and a lock fail period.

3. The display device of claim 2, wherein the control data packet transmitted in the horizontal blank period includes source output enable signal related information for controlling a data output timing of the source driver ICs and polarity control signal related information for controlling a polarity of the data voltage.

4. The display device of claim 2, wherein the control data packet transmitted in the horizontal blank period includes gamma compensation voltage related information for controlling a gamma compensation voltage produced inside the source driver ICs.

5. A method for driving a display device including a display panel including data lines, gate lines crossing the data lines, and pixels arranged in a matrix form, and source driver integrated circuits (ICs) which are connected to a timing controller through data line pairs, the method comprising:

recovering, by the source driver ICs, control information of a control data packet input from the timing controller, and supplying a data voltage of video data to the data lines;

setting, by the timing controller, a number of control data packets transmitted in a horizontal blank period to be less than a number of control data packets transmitted in a period except the horizontal blank period; and defining the number of control data packets based on start information transmitted to the source driver ICs prior to the control data packets by extracting a second control start bit from the start information via a start information extracting unit, wherein the start information includes a first control start bit, the second control start bit, and a control start packet, and wherein the timing controller sets the number of control data packets based on the second control start bit that is subsequent to the first control start bit.

6. The method of claim 5, wherein the period except the horizontal blank period includes a power-on period, a vertical blank period, and a lock fail period.

7. The method of claim 6, wherein the control data packet transmitted in the horizontal blank period includes source output enable signal related information for controlling a data output timing of the source driver ICs and polarity control signal related information for controlling a polarity of the data voltage.

8. The method of claim 6, wherein the control data packet transmitted in the horizontal blank period includes gamma compensation voltage related information for controlling a gamma compensation voltage produced inside the source driver ICs.

9. The display device of claim 1, wherein the second control start bit is configured as two bits, wherein, when the second control start bit is set to low low (LL), the number of control data packets following the second control start bit is one, and wherein, when the second control start bit is set to high high (HH), the number of control data packets following the second control start bit is three.

10. The method of claim 5, wherein the second control start bit is configured as two bits, wherein, when the second control start bit is set to low low (LL), the number of control data packets following the second control start bit is one, and wherein, when the second control start bit is set to high high (HH), the number of control data packets following the second control start bit is three.

11. The display device of claim 1, wherein video data packets of the video data are provided immediately after the control data packets.

12. The method of claim 5, wherein video data packets of the video data are provided immediately after the control data packets.

* * * * *